US008221136B2

(12) United States Patent
Huang et al.

(10) Patent No.: US 8,221,136 B2
(45) Date of Patent: Jul. 17, 2012

(54) ELECTRICAL CONNECTOR WITH TWO CONNECTOR BODIES MOUNTED ON OPPOSITE SURFACES OF A PCB

(75) Inventors: Hsin-Kai Huang, New Taipei (TW); Yu-San Hsiao, New Taipei (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/031,574

(22) Filed: Feb. 21, 2011

(65) Prior Publication Data

US 2011/0263142 A1 Oct. 27, 2011

(51) Int. Cl.
*H01R 12/00* (2006.01)

(52) U.S. Cl. ..... 439/79

(58) Field of Classification Search ..... 439/79, 439/80, 638

See application file for complete search history.

(56) References Cited

FOREIGN PATENT DOCUMENTS

TW M265798 5/2005

*Primary Examiner* — Phuong Dinh

(74) *Attorney, Agent, or Firm* — Wei Te Chung; Andrew C. Cheng; Ming Chieh Chang

(57) ABSTRACT

An electrical connector assembly includes a PCB and a first and a second connector body. The first connector body includes a first housing defining a first coupled face and a mounting face perpendicular to the first coupled face, and first contacts including first contacting portions exposing to the first coupled face and soldering portions exposing to the mounting face and fitly connect on a first surface of the PCB. The second connector body is assembled to the first connector body and includes a second housing including a mating portion with a lengthwise mating slot and a second coupled face confronting with the first coupled face and second contacts including mating portions extending in the lengthwise mating slot and second contacting portions exposing to the second coupled surface and pressing against the first contacting portions. The second housing defines mounting portions seating on a second surface of the PCB.

20 Claims, 12 Drawing Sheets

ELECTRICAL CONNECTOR WITH TWO CONNECTOR BODIES MOUNTED ON OPPOSITE SURFACES OF A PCB

BACKGROUND OF THE INVENTION

1. Field of the Invention

The present invention relates to an electrical connector with two single connector bodies engaged with each other while retained on opposite surfaces of a printed circuit board.

2. Description of Related Arts

TW Pat. Issue No. M265798 issued to Molex on May 21, 2005, discloses a floating electrical connector of two-pieces including a base seat loaded with a plurality of transferring contacts retained thereon and a mating head mounted with a plurality of mating contacts. The base seat is mounted on a printed circuit board and the mating head is floatingly assembled to the base seat. The mating contacts have one ends inserted in the base seat to touch with the transferring contacts of the base seat. When the mating head is inserted by a complementary connector, the mating head can move in a slight range along the complementary connector through said both contacts of the connector, thereby the damage might occur to the complementary connector might avoid.

However, in some way the base seat increases the whole height on the printed circuit. Hence, a new electrical connector is hoped to be desired.

SUMMARY OF THE INVENTION

An electrical connector assembly comprises a printed circuit board defining a first surface and a second surface opposite to the first surface, a first and a second connector body. The first connector body comprises a first housing and a plurality of first contacts loaded in the first housing. The first housing defines a first coupled face and a mounting face perpendicular to the first coupled face. The first contacts comprises first contacting portions exposing to the first coupled face and soldering portions exposing to the mounting face and fitly connect on the first surface of the printed circuit board. The second connector body is assembled to the first connector body. The second connector body comprises a second housing and a plurality of second contacts loaded in the second housing. The second housing comprises a mating portion with a lengthwise mating slot and a second coupled face confronting with the first coupled face of the first connector body. The second contacts comprises mating portions extending in the lengthwise mating slot and second contacting portions exposing to the second coupled surface and pressing against the first contacting portions of the first connector body. The second housing defines at least one mounting portion seating on the second surface of the PCB.

Other advantages and novel features of the invention will become more apparent from the following detailed description of the present embodiment when taken in conjunction with the accompanying drawings.

DETAILED DESCRIPTION OF THE PREFERRED EMBODIMENT

Figure 1:
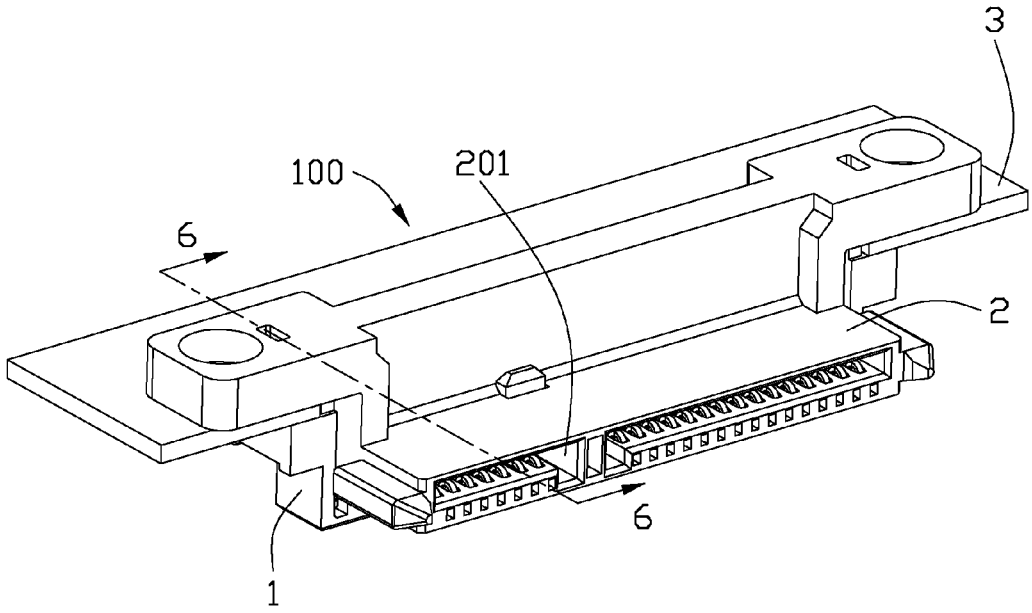
FIG. 1 is a perspective view of an electrical connector assembly of a first embodiment in accordance with the present invention, wherein an electrical connector is mounted on a PCB.

Next, two embodiments of the invention will de described with reference to the figures. FIGS. 1 to 6 show a first embodiment and FIGS. 7-12 show a second embodiment. As shown in FIG. 1, the electrical connector assembly 100 of the first embodiment includes a first connector body 1 permanently soldered on a printed circuit board (PCB) 3 and a second connector body 2 which is assembled with the first connector body and attached on the printed circuit board, intending to mate with a complementary connector (not shown) through mating slots 201.

Figure 2:
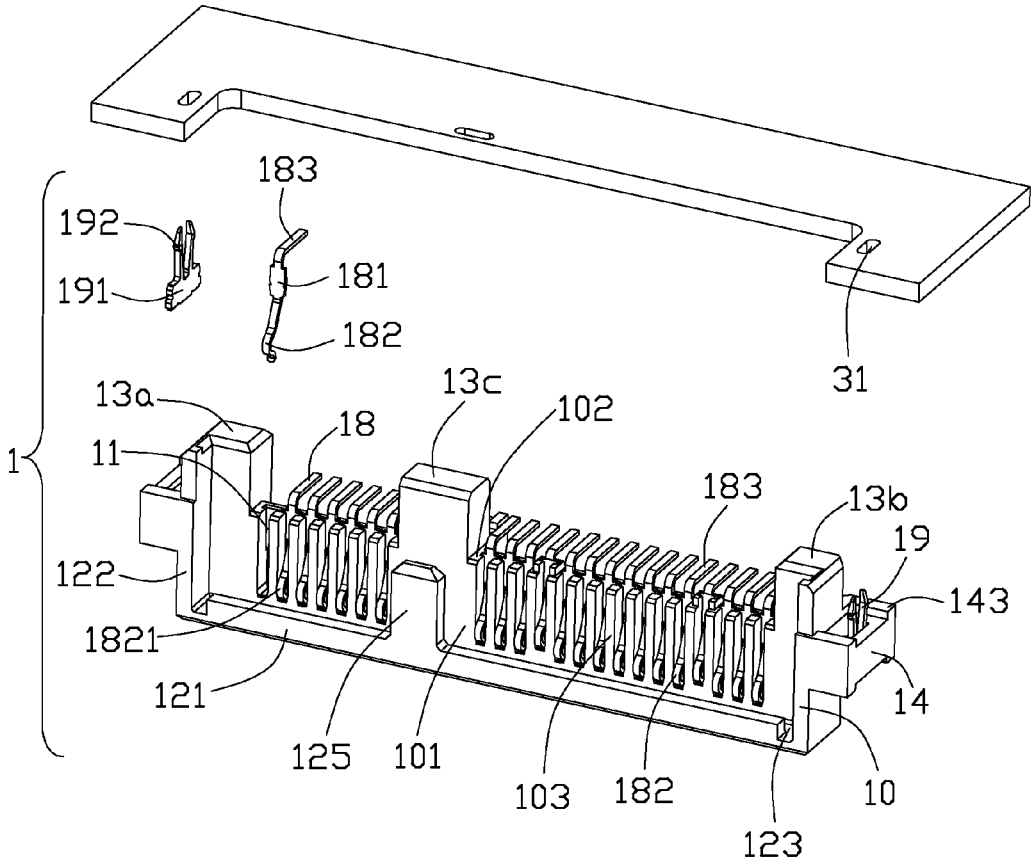
FIG. 2 is an exploded perspective view of the electrical connector assembly with a first connector body and the PCB.

Referring to FIG. 2, the first connector body 1 includes a first housing 10 made from insulating material and a plurality of first contacts 18 made from metal sheet. The first housing 10 defines a first coupled face 101 recessed with a plurality of contact passageways 11 arranged along a lengthwise direction and extending through a top face thereof in a vertical direction perpendicular to the lengthwise direction. The top face of first coupled face is defined as a mounting face 102. The first contacts 18 include retaining portions 181 retained in the passageways 11 and elastic contacting portions 182 extending downward away the mounting face 102 with distal ends 1821 projecting beyond the coupled face 101. Another ends of the first contacts 18 extend perpendicularly to the retaining portions 181 and away the coupled face 101 to form soldering portions 183 horizontal to the mounting face 102. Three positioning posts 13*a*, 13*b*, 13*c* extend upwards from the mounting face 101 and the first contacts are divided to two groups. One faces of the positioning posts 13*a*, 13*b*, 13*c* are co-planar with the coupled face 101.

Figure 5:
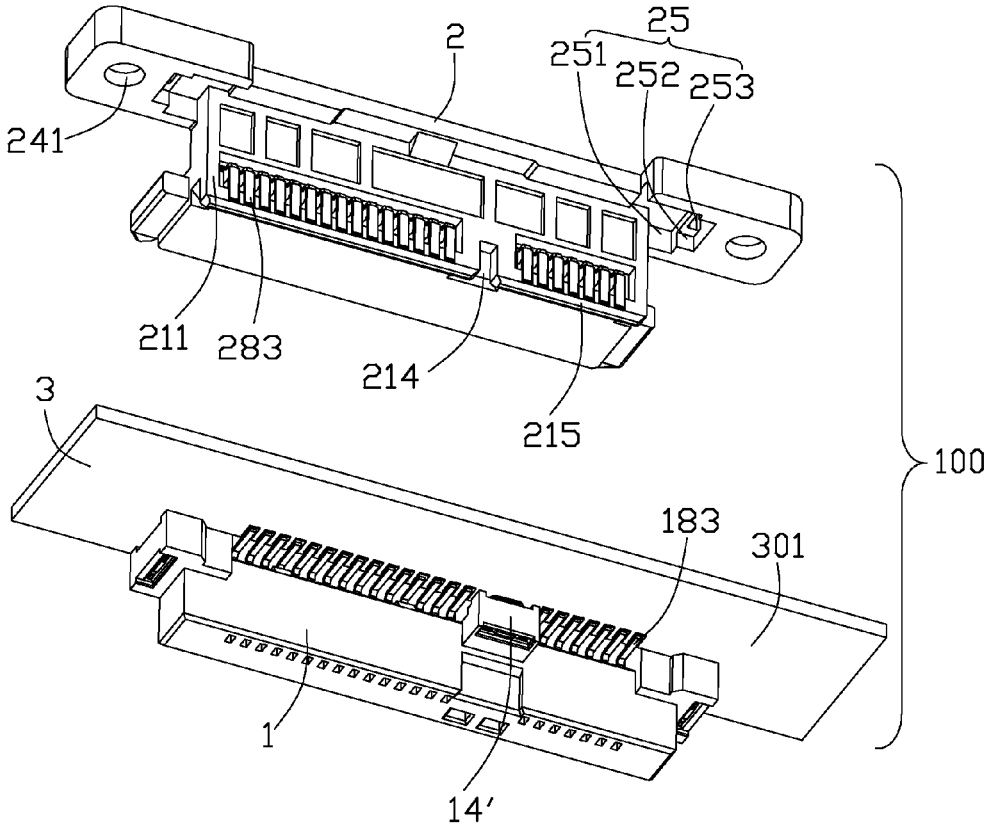
FIG. 5 is a rear and top, perspective view of the first electrical connector.
Figure 6:
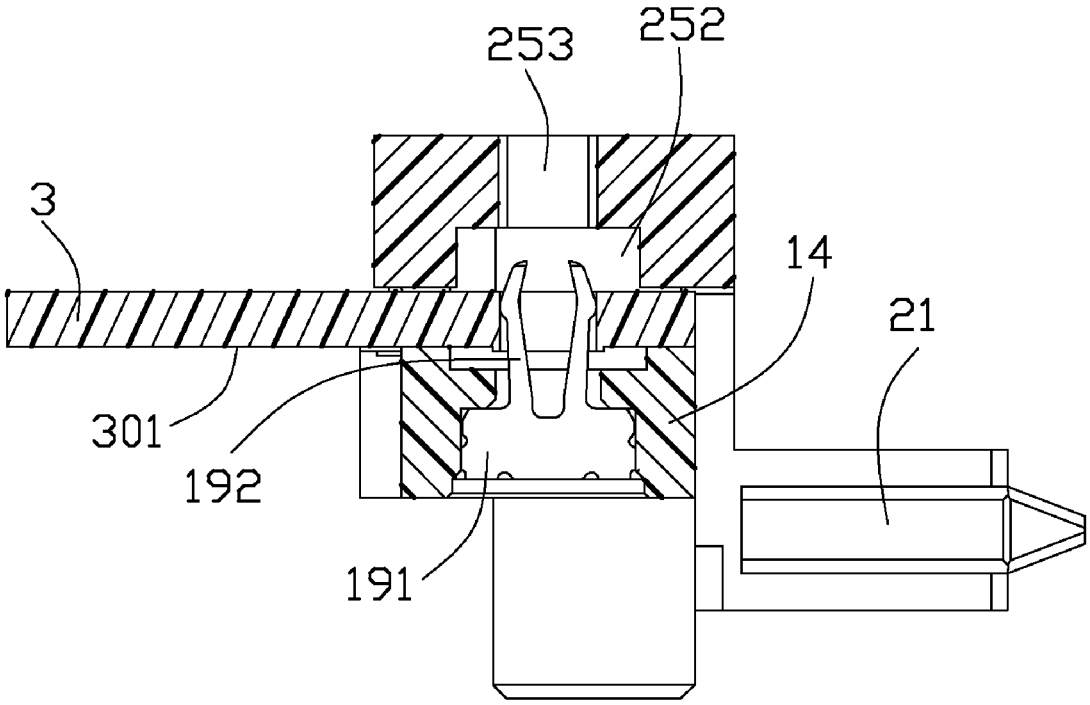
FIG. 6 is a cross sectional view of the electrical connector assembly taken along line 6-6.
Figure 7:
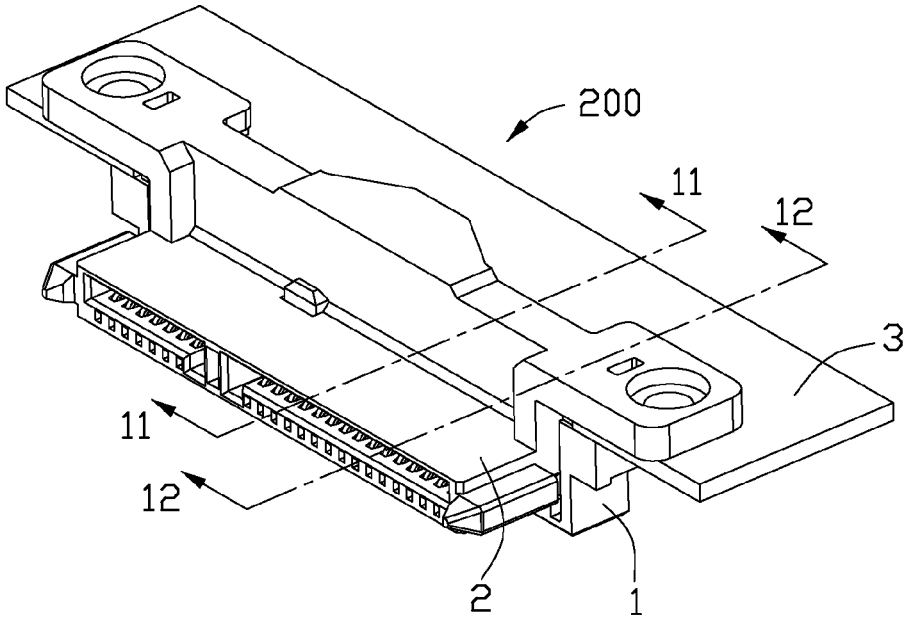
FIG. 7 is a perspective view of an electrical connector assembly of a second embodiment in accordance with the present invention.
Figure 8:
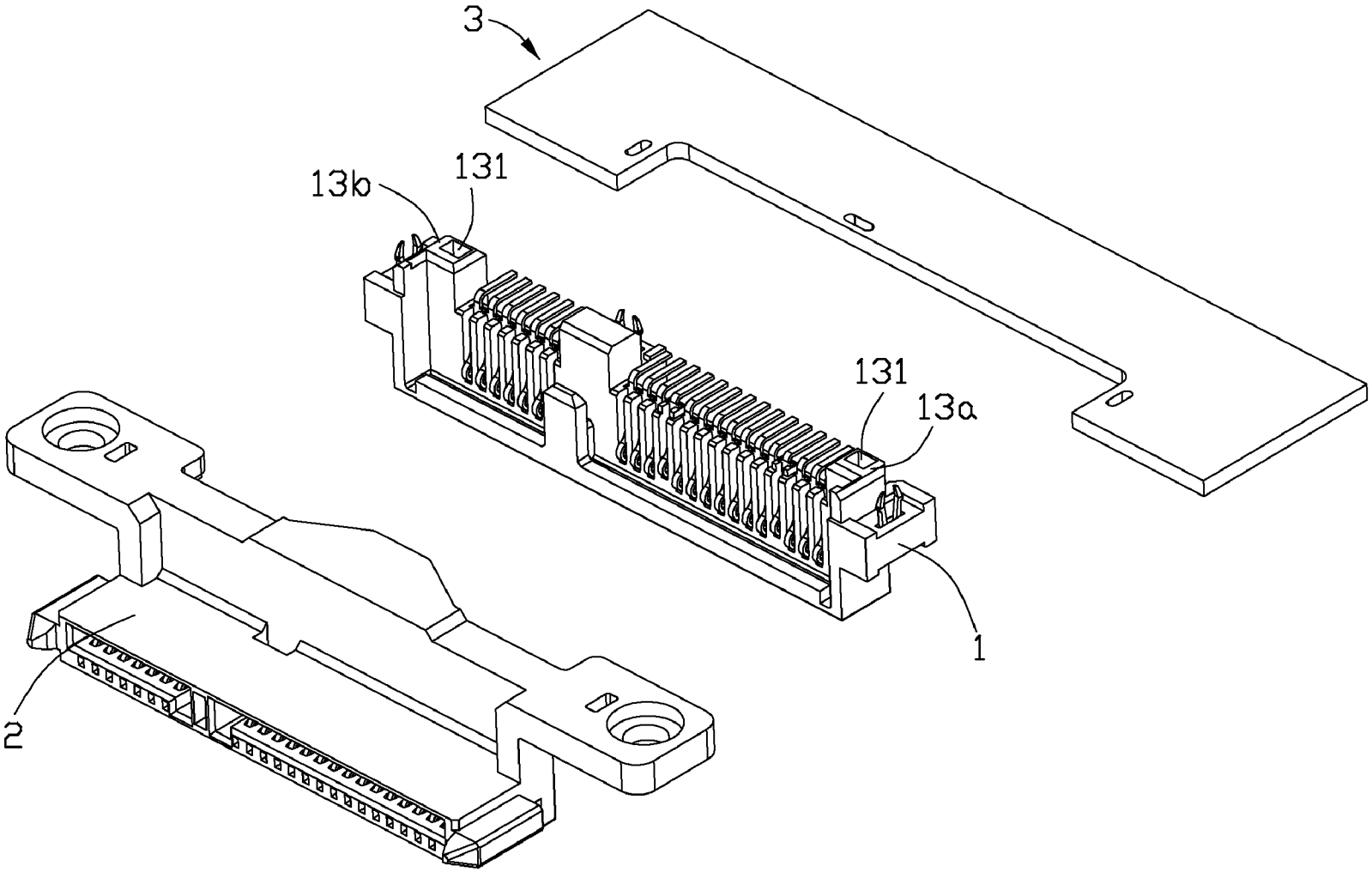
FIG. 8 is a front and top, exploded perspective view of the electrical connector assembly.
Figure 9:
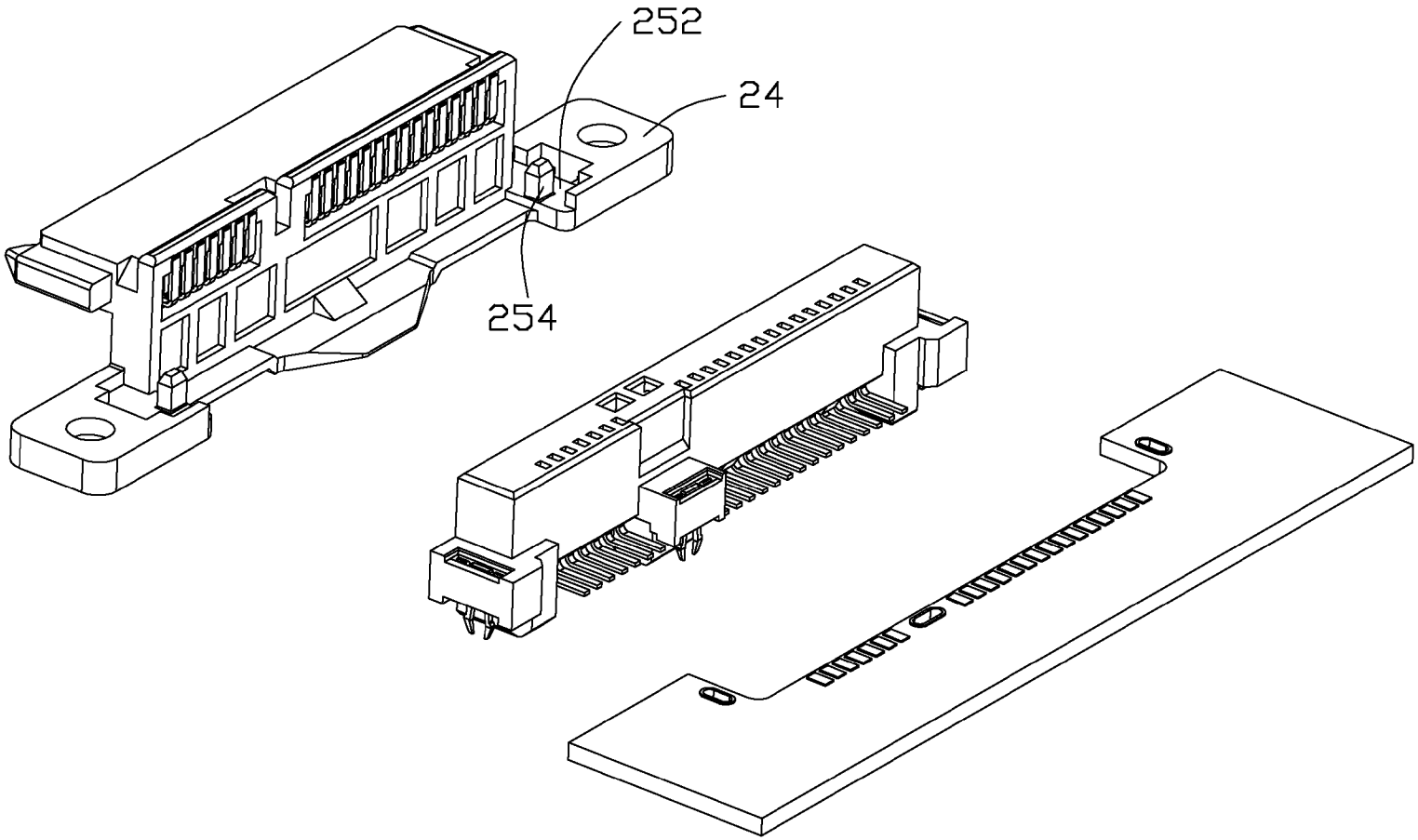
FIG. 9 is a rear and top, exploded perspective view of the electrical connector assembly.
Figure 10:
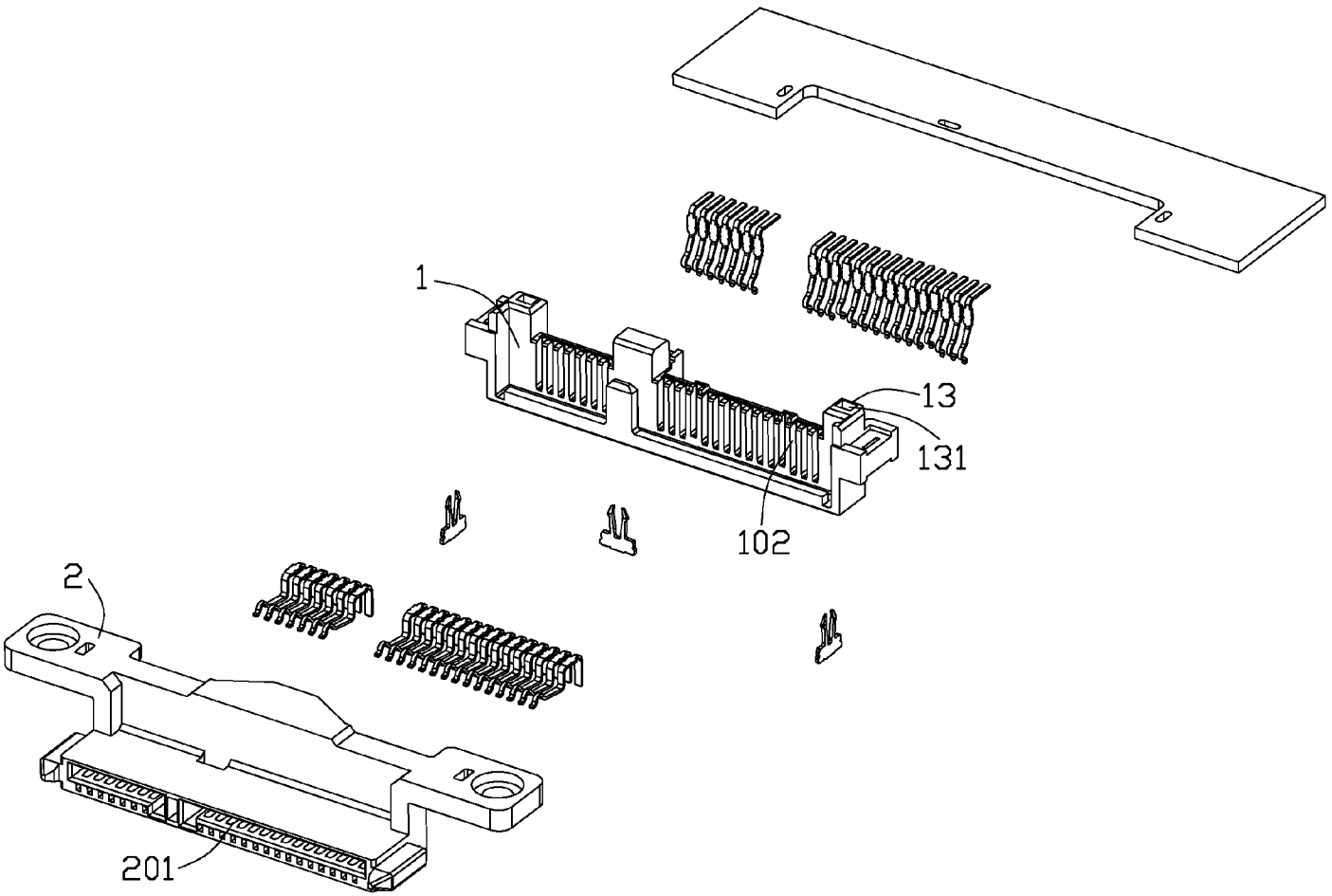
FIG. 10 is a front and top, exploded perspective view of the electrical connector assembly.
Figure 11:
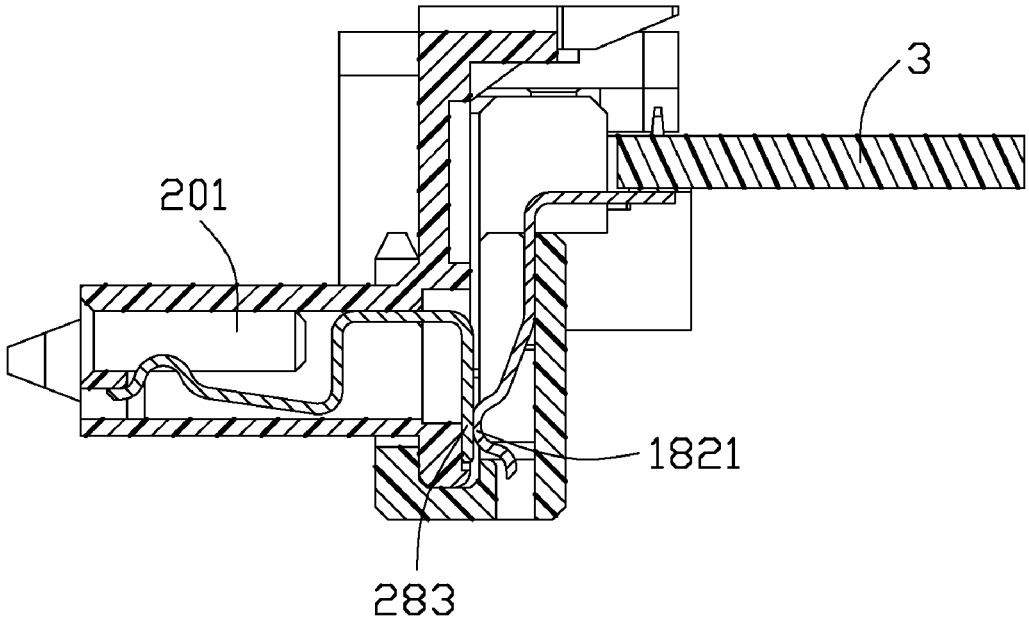
FIG. 11 is a cross sectional view of the electrical connector assembly taken along line 11-11 of FIG. 7.
Figure 12:
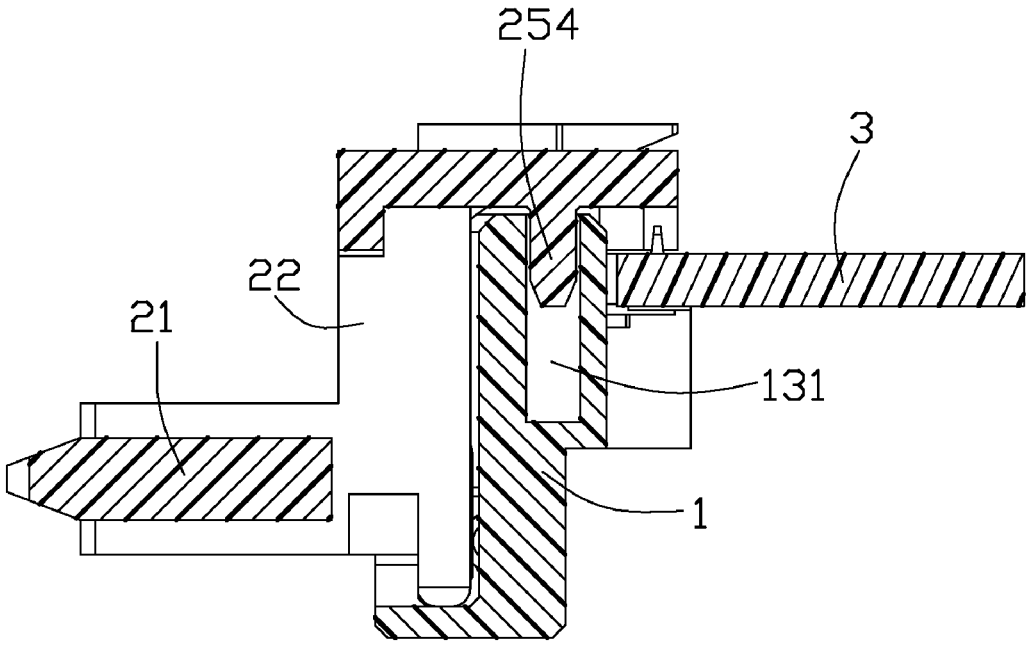
FIG. 12 is a cross sectional view of the electrical connector assembly taken along line 12-12 of FIG. 7.

The first housing 10 further defines a lengthwise rib 121 disposed at a bottom thereof and spaced away from the coupled face 101 with a lengthwise slot 123. A guiding post 125 proceeds upwards from the lengthwise rib 121, which is parallel to the positioning post 13*c* but do not extend beyond the mounting face 102. The first housing 10 further defines a pair of vertical ribs 122 at two sides of the coupled face 101. A coupled room 103 is limited among the lengthwise rib 121, vertical ribs 122 and the coupled face 101. The first housing 10 defines a pair of mounting portions 14 extending outward from outside faces at two ends thereof, the mounting portions has a top face 141 coplanar with the mounting face 102 and the soldering portions 183 on which the printed circuit board 3 sit. A pair of board locks 19 is retained in the mounting portions 14, wherein as shown in FIG. 6 a pair of retaining portions 191 are retained in slots of the mounting portions 14 and a pair of board legs 192 extend upwards beyond the mounting face 102 to be retained in the PCB. Referring to FIG. 5, the first housing 10 is also disposed with a second mounting portion 14' retained with a board lock in vicinity of the positioning post 13*c*.

Figure 4:
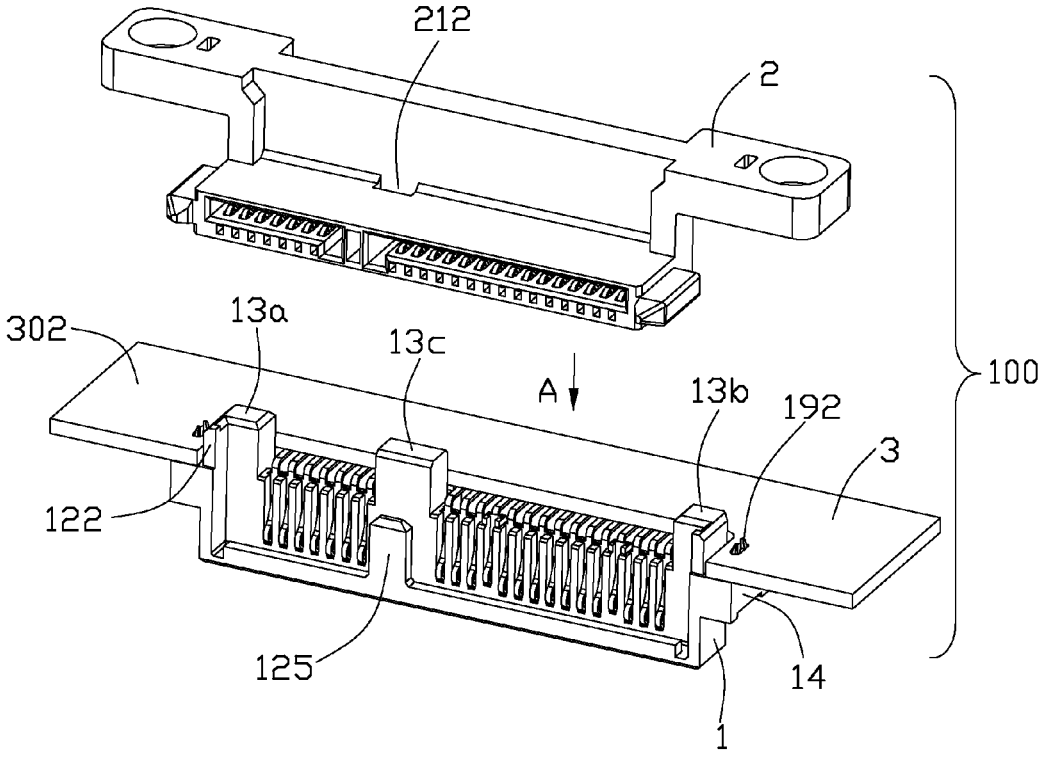
FIG. 4 is a front and top, exploded perspective view of the electrical connector assembly.

Referring to FIGS. 2, 4 and 5, the first housing 10 is mounted on a first surface 301 or lower surface of the PCB 3 on which a plurality of conductive pads are defined to be permanently connected with the soldering portions 183 of the first contacts by soldering process. Three through holes 31 defined at an edge of a notch the PCB where the first housing is seated, are inserted and retained with the locking legs 192 so that the PCB is fitly seated on the mounting face 102. The positioning posts 13*a*~13*c* and the vertical ribs 121 have a common top face projecting beyond a second surface 302 or upper surface of the PCB 3.

Figure 3:
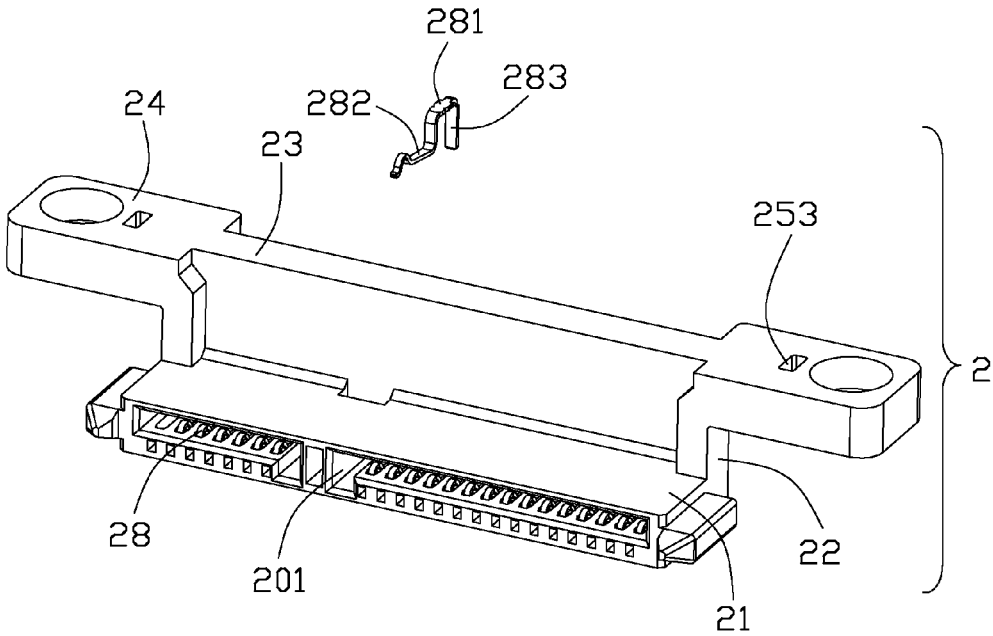
FIG. 3 is an exploded perspective view of the second connector body.

Referring to FIG. 3, the second connector body 2 includes a second housing 20 made from insulating material and a plurality of second contacts 28 made from metal sheet. The second housing 2 has a horizontal mating portion 21 and a vertical portion 22 and a mounting board 23 at a top of the vertical portion 22. The mounting board 23 is parallel to the mating portion. A pair of mounting portions 24 extends outwards at two ends of the mounting board. The mating portion 21 defines two spaced lengthwise slots 201 running through a front face thereof. The second contacts 28 comprise retained portions 281, mating portions 282 extend in the lengthwise slots 201 and contacting portions 283. As best shown in FIG. 5, the contacting portions 283 are of board shape. A rear face 211 of the mating portion 21 opens rearwards and the contacting portions 283 expose to the rear face. Each mounting portion 24 defines a recess 25 at a bottom face thereof adjacent to the vertical portion 22 and a circle through holes 241 at outside of the recess 25. The recess 25 comprising a positioning hole 251 and a receiving hole 252 wherein the receiving hole is disposed near to the through hole 241 and smaller than the positioning hole in dimension. The receiving holes 252 run through the top face of the mounting portion 24 to form a rectangular hole 253.

Please referring to FIG. 3 through FIG. 6, an assembly of the first and second housing is given below. After the first housing 10 is assembled on the first surface 301 of the PCB, the second housing 20 is assembled on the second surface 302 of the PCB along a direction (Arrow A), wherein the positioning hole 251 of the recess 25 is just aligned with and inserted with the two positioning posts 13*a*, 13*b* and vertical rib 122, and the positioning post 13*c* is inserted in the positioning hole 214 on a middle portion of the rear face 211 of the mating portion, the guiding post 125 just go across the slots 212 defined on the mating portion. The contacting portions 182 of the first contacts 18 just press against the board contacting portions 283 of the second connector body 2. The rear face of the second connector body is received in the coupled room 103 and the positioning rib 215 extend downwards from the rear face 211 is received in the lengthwise slot 123 of the first connector body 1 for preventing a downward movement of the second connector body 2. Combination with FIG. 6, the mounting portions 14 space away from the mounting portions 24 of the second connector body with predetermined distances to just clip the PCB 3. The locking legs 192 extend upwards to be contained in the receiving holes 252 of the mounting face of the first connector body. The first connector body 1 and the second connector body 2 are seated on two opposite surfaces of the PCB 3, which benefits a force release between the connector bodies to the PCB.

The electrical connector 200 of the second embodiment will be simply introduced with reference FIG. 7 through FIG. 12, wherein depicted elements are not necessarily shown to scale and wherein like or similar elements are designated by same or similar reference numeral and terminology in the second embodiment. The three positioning posts 13*a*, 13*b* of the first connector body 1 each define a retaining hole 131 through the top face thereof. The second connector body 2 defines a retaining post 254 extending from a bottom face of the positioning hole 252 at each mounting portion 24.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector assembly comprising:

a printed circuit board defining a first surface and a second surface opposite to the first surface;

a first connector body comprising a first housing and a plurality of first contacts loaded in the first housing, the first housing defining a first coupled face and a mounting face perpendicular to the first coupled face, the first contacts comprising first contacting portions exposing to the first coupled face and soldering portions exposing to the mounting face and fitly connect on the first surface of the printed circuit board;

a second connector body assembled to the first connector body, the second connector body comprising a second housing and a plurality of second contacts loaded in the second housing, the second housing comprising a mating portion with a lengthwise mating slot and a second coupled face confronting with the first coupled face of the first connector body, the second contacts comprising mating portions extending in the lengthwise mating slot and second contacting portions exposing to the second coupled surface and pressing against the first contacting portions of the first connector body;

wherein the second housing defines at least one mounting portion seating on the second surface of the PCB.

2. The electrical connector assembly as described in claim 1, wherein the first housing defines a pair of mounting portions at two opposite ends thereof, the mounting portions and the soldering portions of the first contacts is on a same plane to support the printed circuit board.

3. The electrical connector assembly as described in claim 2, wherein the mounting portions of the first connector body are retained with board locks, each board lock comprising a locking leg extending to be inserted in corresponding through hole defined on the printed circuit board.

4. The electrical connector assembly as described in claim 3, wherein the first housing defines positioning posts extending from the mounting face away from the first coupled surface which are inserted in the positioning holes defined on the at least one mounting portion of the first housing to assemble the first and the second connector bodies together, the positioning posts have a face coplanar with the first coupled face.

5. The electrical connector assembly as described in claim 1, wherein a receiving hole is defined at one side of the positioning hole and the locking leg is received in the receiving hole.

6. An electrical connector comprising:

a first connector body comprising a first housing and a plurality of first contacts in the first housing, the first housing defining a first coupled face and a mounting face perpendicular to the first coupled face, the first contacts comprising contacting portions exposing to the coupled face and soldering portion extending along the mounting;

a second connector body assembled to the first connector body, the second connector body comprising a second housing and a plurality of second contacts loaded in the second housing, the second housing comprising a mating portion with a lengthwise mating slot and a second coupled face confronting with the first coupled face of the first connector body, the second contacts comprising mating portions extending in the lengthwise mating slot and second contacting portions exposing to the second coupled surface and pressing against the first contacting portions of the first connector body;

the first housing defining a pair of positioning posts extending upright from the mounting face thereof and a pair of mounting portions having a top face coplanar with the mounting face, and the second housing defining a pair of receiving holes to receive the positioning posts.

7. The electrical connector as described in claim 6, wherein the first housing comprises a pair of mounting portions at two opposite ends thereof, the mounting faces have a top face coplanar with the mounting face.

8. The electrical connector as described in claim 7, wherein the positioning posts each define a retaining post to be inserted with a retaining post integrally projecting from the receiving hole of the second housing of the second connector body.

9. The electrical connector assembly as described in claim 8, wherein the first contacting portions of the first contacts extend away the soldering portions.

10. An electrical connector assembly comprising:

a first connector body including:

a first insulative housing defining a first mounting surface thereon for mounting to a first surface of a printed circuit board in a first vertical direction;

a plurality of first contacts disposed in the first housing, each of said first contacts defining a first contacting portion and a first tail portion for mounting to the printed circuit board; and a second connector body assembled to the first connector body in a vertical direction and including:

a second insulative housing defining a horizontal mating portion for mating with a complementary connector in a horizontal direction perpendicular to said first vertical direction, and a vertical portion located behind the horizontal mating portion;

a plurality of second contacts disposed in the second housing, each of said second contacts defining a mating portion disposed in the horizontal mating portion, and a second contacting portion located behind the mating portion and contacting the first contacting portion; and complementary interengaging devices respectively formed on the first housing and around the vertical portion of the second housing so as to have the second housing up and down moveable relative to the first housing in said first vertical direction; wherein the first housing and the second housing are configured to allow said second housing to be assembled to the first housing only in a second vertical direction opposite to the first vertical direction to have said complementary interengaging devices coupled to each other.

11. The electrical connector assembly as claimed in claim 10, wherein the second housing includes a base extending in said horizontal direction for confronting, in said first vertical direction, a second surface of the printed circuit board opposite to the first surface.

12. The electrical connector assembly as claimed in claim 11, wherein said base and said horizontal mating portion are respectively located at two opposite ends of the vertical portion in the first and second vertical direction.

13. The electrical connector assembly as claimed in claim 10, further including said printed circuit board, wherein said printed circuit board defines a cutout through which the complementary interengaging devices vertically extend.

14. The electrical connector assembly as claimed in claim 13, wherein said horizontal mating portion is essentially located in front of the printed circuit board.

15. The electrical connector assembly as claimed in claim 14, wherein the printed circuit board is higher than the horizontal mating portion in said first vertical direction.

16. The electrical connector assembly as claimed in claim 15, wherein the second housing further includes a base extending in said horizontal direction for confronting, in said first vertical direction, a second surface of the printed circuit board opposite to the first surface.

17. The electrical connector assembly as claimed in claim 16, wherein said base defines a second mounting surface for seating upon the second surface of the printed circuit board so as to have the printed circuit board is sandwiched between the first mounting surface of the first housing and the second mounting surface of the second housing.

18. The electrical connector assembly as claimed in claim 16, wherein the printed circuit board is essentially higher than the first contacting portions of the first contacts and the second contacting portions of the second contacts in the first vertical direction.

19. The electrical connector assembly as claimed in claim 10, wherein the first contacting portions of the first contacts are forwardly exposed upon the first housing and the second contacting portions of the second contacts are rearwardly exposed upon the second housing so as to be coupled to the corresponding first contacting portions of the first contacts horizontally when the first housing and the second housing are assembled to each other.

20. The electrical connector assembly as claimed in claim 10, wherein the complementary interengaging devices on the first housing include a high part which is essentially coupled to the vertical portion of the second housing, and a low part which is coupled to a joint between the vertical portion and the horizontal mating portion of the second housing.

* * * * *